US006644228B2

(12) United States Patent
Valle et al.

(10) Patent No.: US 6,644,228 B2
(45) Date of Patent: Nov. 11, 2003

(54) SEWING MACHINE FOR FORMING RUNNING-STITCH SEAMS

(75) Inventors: Mario Valle, Pavia (IT); Ferruccio Perego, Milan (IT)

(73) Assignee: Conti Complett S.p.A., Milan (IT)

( * ) Notice: Subject to any disclaimer, the term of this patent is extended or adjusted under 35 U.S.C. 154(b) by 90 days.

(21) Appl. No.: 10/050,971

(22) Filed: Jan. 22, 2002

(65) Prior Publication Data

US 2002/0112655 A1 Aug. 22, 2002

(30) Foreign Application Priority Data

Feb. 19, 2001 (IT) ..... MI2001A0336

(51) Int. Cl.[7] ..... D05B 1/04
(52) U.S. Cl. ..... 112/173
(58) Field of Search ..... 112/248, 187, 112/173, 281, 170, 262, 171, 172, 94, 189, 181, 227, 261, 222, 224

(56) References Cited

U.S. PATENT DOCUMENTS 2,622,551 A * 12/1952 Gerber ..... 112/94
3,207,107 A * 9/1965 Castany Ferre ..... 112/170
3,238,903 A * 3/1966 Pav ..... 112/16
4,122,787 A * 10/1978 Conti ..... 112/170

FOREIGN PATENT DOCUMENTS

| | | |
|---|---|---|
| GB | 1 541 076 | 2/1979 |
| JP | 57 034887 | 2/1982 |

* cited by examiner

*Primary Examiner*—Ismael Izaguirre
(74) *Attorney, Agent, or Firm*—Guido Modiano; Albert Josif; Daniel O'Byrne

(57) ABSTRACT

The machine comprises a needle with an open eye orientated perpendicular to a supporting surface for the sewn item and actuated with reciprocating motion to pass cyclically through the supporting surface and the sewn item, carrying a thread loop; a thread take-up wheel having a fixed part, with a magazine for taken-up thread, and a rotatable part; a lower looper engaging the thread loop below the supporting surface and loading the thread into the magazine; and comprises a thread handly unit allowing correct formation of the stitches.

7 Claims, 11 Drawing Sheets

SEWING MACHINE FOR FORMING RUNNING-STITCH SEAMS

BACKGROUND OF THE INVENTION

The present invention relates to a sewing machine for forming running-stitch seams.

Sewing machines for forming a seam with a so-called running stitch are known; said seam is formed with a single thread of preset length, known as draw, and is composed of stitches that are alternately visible on either side of the fabric being sewn.

A machine of this kind is disclosed in U.S. Pat. No. 4,122,787 and is substantially composed of a needle that has a substantially vertical axis and is provided, proximate to its tip, with an open eye and is orientated so that its axis is substantially perpendicular to a supporting surface on which the item being sewn is deposited.

The needle is actuatable with a reciprocating motion along its axis in order to pass cyclically through the item deposited on the supporting surface, carrying in each instance below and above the supporting surface a loop of thread of the draw used for the seam. One end of the draw is clamped beforehand above the item being sewn, while the other end of the draw is left loose.

Below the supporting surface there is a thread take-up wheel, which is arranged on a plane that is substantially parallel to the axis of the needle and is orientated so that its axis is substantially perpendicular to the axis of the needle. Said wheel is composed of a fixed part, in which there is a magazine for the taken-up thread, and of a rotatable part, which can be actuated with a rotary motion about its own axis. The rotatable part of the wheel is mounted coaxially on an actuation shaft, which can be actuated with a rotary motion about its own axis synchronously with the movement of the needle, and has, in a peripheral region, a looper or lower looper which, as a consequence of the rotation of the rotatable part of the wheel and of the movement of the needle, engages the loop of thread carried below the supporting surface by the needle and takes up the portion of thread that lies between the looper and the free end of the draw, making it pass inside the magazine provided in the fixed part of the wheel.

The machine is completed by thread handling means, which are located below the supporting surface, and by another looper, or upper looper, which is arranged above the supporting surface laterally to the needle and is meant to engage the loop of thread carried by the needle above the supporting surface and retain it while the thread is loaded by the lower looper in the magazine formed in the fixed part of the wheel.

The thread handling means comprise means for moving the portion of thread that lies below the supporting surface between the item being sewn and the thread magazine formed in the wheel away from the path of the needle in order to prevent said needle from engaging it during specific steps of the forming of the stitches.

The thread handling means also comprise means for moving said portion of thread toward the path of the needle, so as to place the thread against the shank of the needle above the eye, while said eye is located below the item being sewn, so that the subsequent upward motion of the needle causes the eye of the needle to engage the thread and form a loop of thread that is carried above the item being sewn.

The thread handling means further comprise a clamp, which is arranged proximate to the inlet of the magazine formed in the wheel and is meant to block the thread in order to prevent it from being extracted from the take-up magazine while the thread movement means move it away and then toward the path of the needle.

In order to prevent interference, during the loading of one part of the thread inside the magazine formed in the wheel and the simultaneous extraction of another part of thread from the same magazine, between the two thread parts that move in mutually opposite directions, there are appropriate separator means that mutually space said two thread parts.

The use of a clamp, which acts cyclically on the thread by clamping it and releasing it in order to allow it to slide for loading in the magazine and allow its subsequent extraction, has the problem of causing wear of the sewing thread, which can compromise the correct execution of the seam.

SUMMARY OF THE INVENTION

The aim of the present invention is to solve the above described problem, by providing a sewing machine for forming running-stitch seams that can operate correctly even without clamping the thread below the supporting surface, thus avoiding deterioration of the sewing thread.

Within this aim, an object of the invention is to provide a sewing machine in which the thread handling elements arranged below the supporting surface are structurally simpler than those of known types of running-stitch sewing machine.

Another object of the invention is to provide a sewing machine that ensures highly regular execution of stitches.

Another object of the invention is to provide a sewing machine for forming running-stitch seams that ensures a substantially uniform tension of the thread during the formation of the stitches.

This aim and these and other objects that will become better apparent hereinafter are achieved by a sewing machine for forming running-stitch seams, comprising a needle which has, proximate to its tip, an open eye and is orientated so that its axis is substantially perpendicular to a surface for supporting the item being sewn, and means for clamping one end of a draw of thread which are arranged above said supporting surface; said needle being actuatable with a reciprocating motion along its own axis in order to pass cyclically through the item being sewn and said supporting surface, carrying in each instance below and above said supporting surface a loop of thread of said draw in which one end is clamped at the beginning of the seam by said clamping means and the other end is free; a thread take-up wheel being provided below said supporting surface, being arranged on a plane that is substantially parallel to the axis of said needle, and being orientated so that its axis is substantially perpendicular to the axis of said needle; said wheel being composed of a fixed part, in which there is a magazine for the taken-up thread, and of a rotatable part, which can be rotationally actuated about its own axis; said rotatable part of the wheel being mounted coaxially on an actuation shaft that can be rotationally actuated about its own axis synchronously with the movement of said needle and supporting a lower looper that can engage the loop of thread carried below said supporting surface by said needle in order to take up, below said supporting surface, the portion of draw that lies between said needle and the free end of the draw and load it into said magazine formed in the fixed part of the thread take-up wheel; means for handling the thread being provided below said supporting surface and comprising means for moving the portion of thread that lies between the item being sewn and said thread magazine away from the path of the needle, means being also provided for moving said portion of thread toward the path of the needle, means being further provided for separating the two parts of the loop of thread engaged by said lower looper, characterized in that said means for moving the thread toward the path of the needle comprise a fork element and in that said separator means comprise a separator element that is arranged proximate to said fork element and can move so as to open the fork of said fork element in order to allow the entry in the fork of a segment, located below said supporting surface, of the part of the loop of thread that lies, in each instance, between said lower looper and said end of the draw clamped at the beginning of the seam and close the fork of said fork element in order to retain inside said fork said segment of the part of the loop of thread.

BRIEF DESCRIPTION OF THE DRAWINGS

Further characteristics and advantages of the invention will become better apparent from the description of a preferred but not exclusive embodiment of the machine according to the invention, illustrated only by way of non-limitative example in the accompanying drawings, wherein.

DESCRIPTION OF THE PREFERRED EMBODIMENTS

Figure 1:
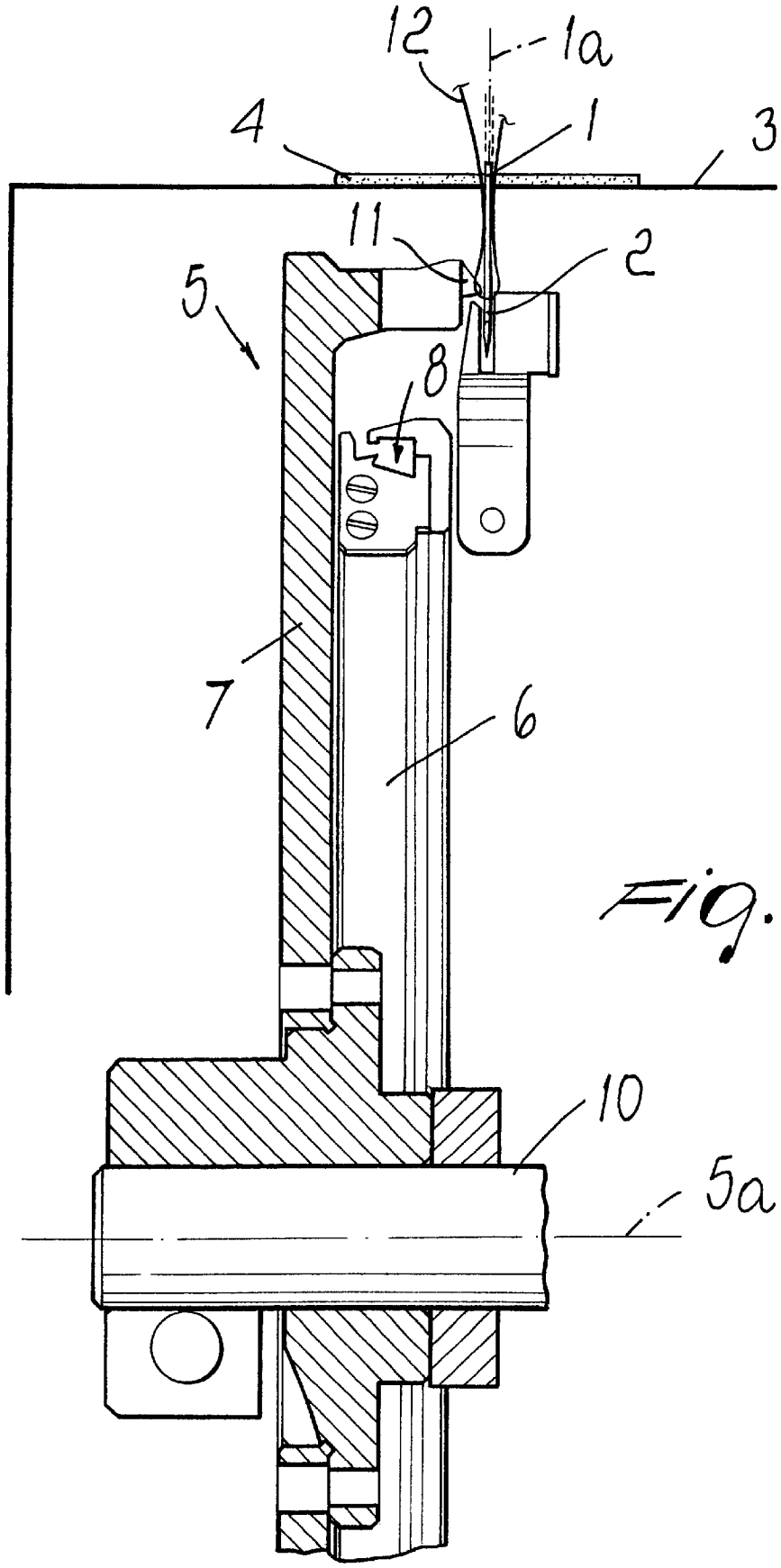
FIG. 1 is a front elevation view of some of the elements that compose the machine according to the invention, arranged below the surface that supports the item being sewn, with the fixed part of the thread take-up wheel shown only partially.
Figure 2:
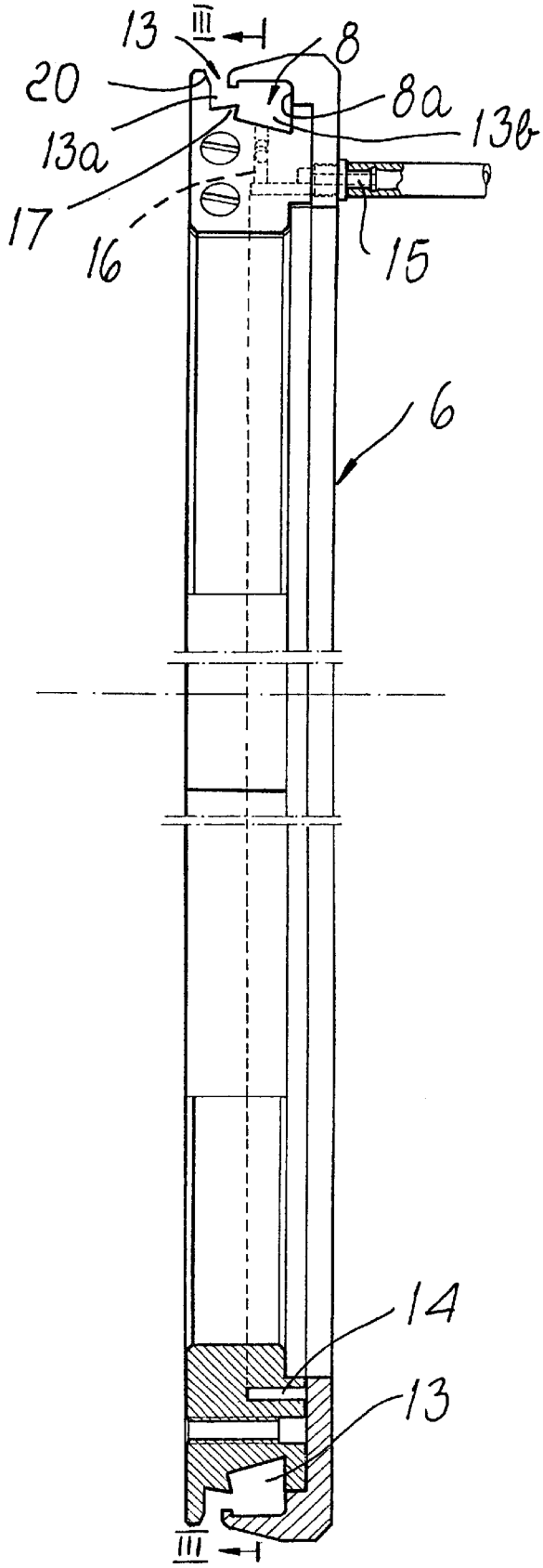
FIG. 2 is a partially sectional enlarged-scale front elevation view, similar to FIG. 1, of the fixed part of the thread take-up wheel.
Figure 3:
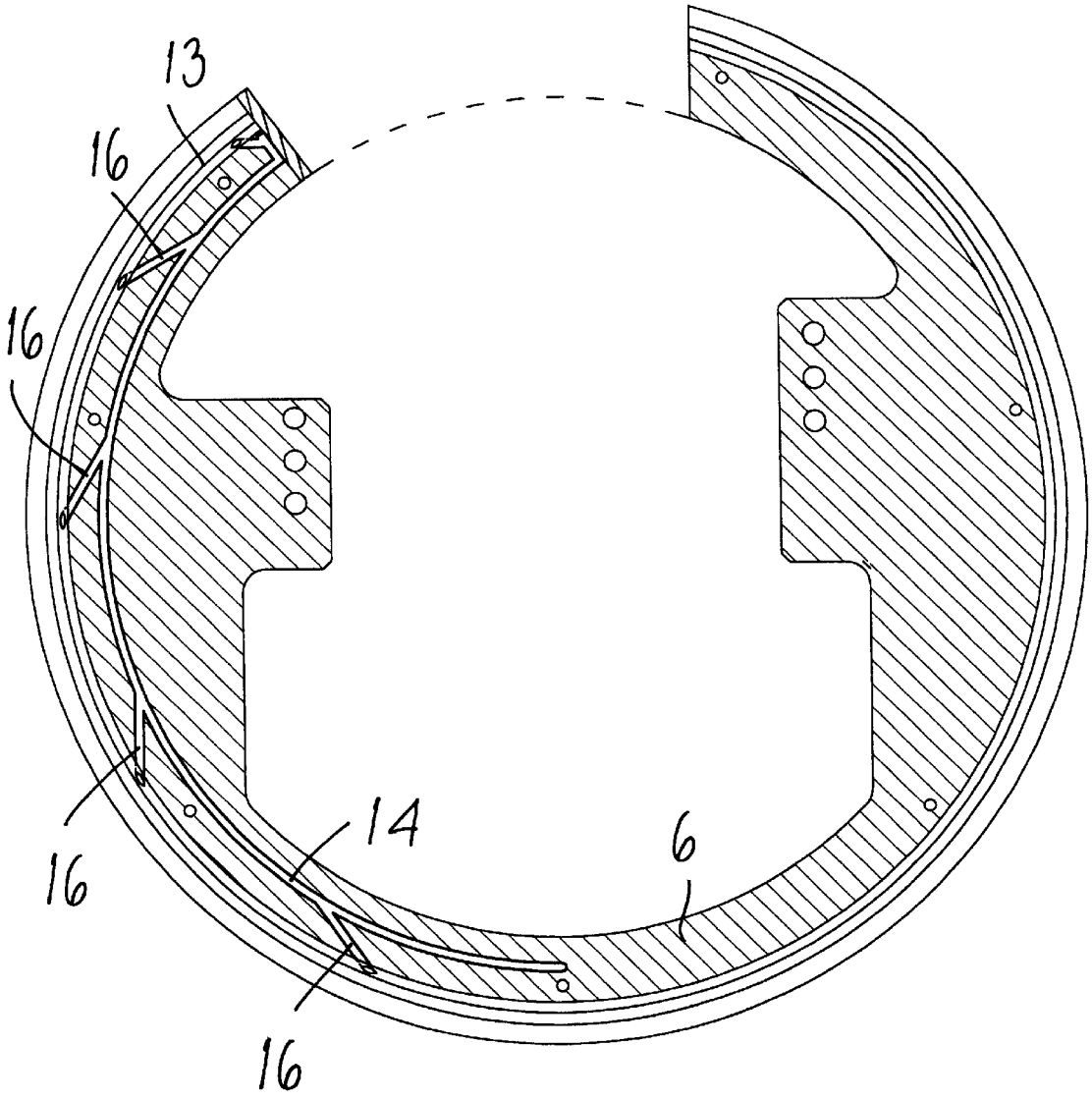
FIG. 3 is a reduced-scale sectional view of FIG. 14, taken along the line III—III.
Figure 4:
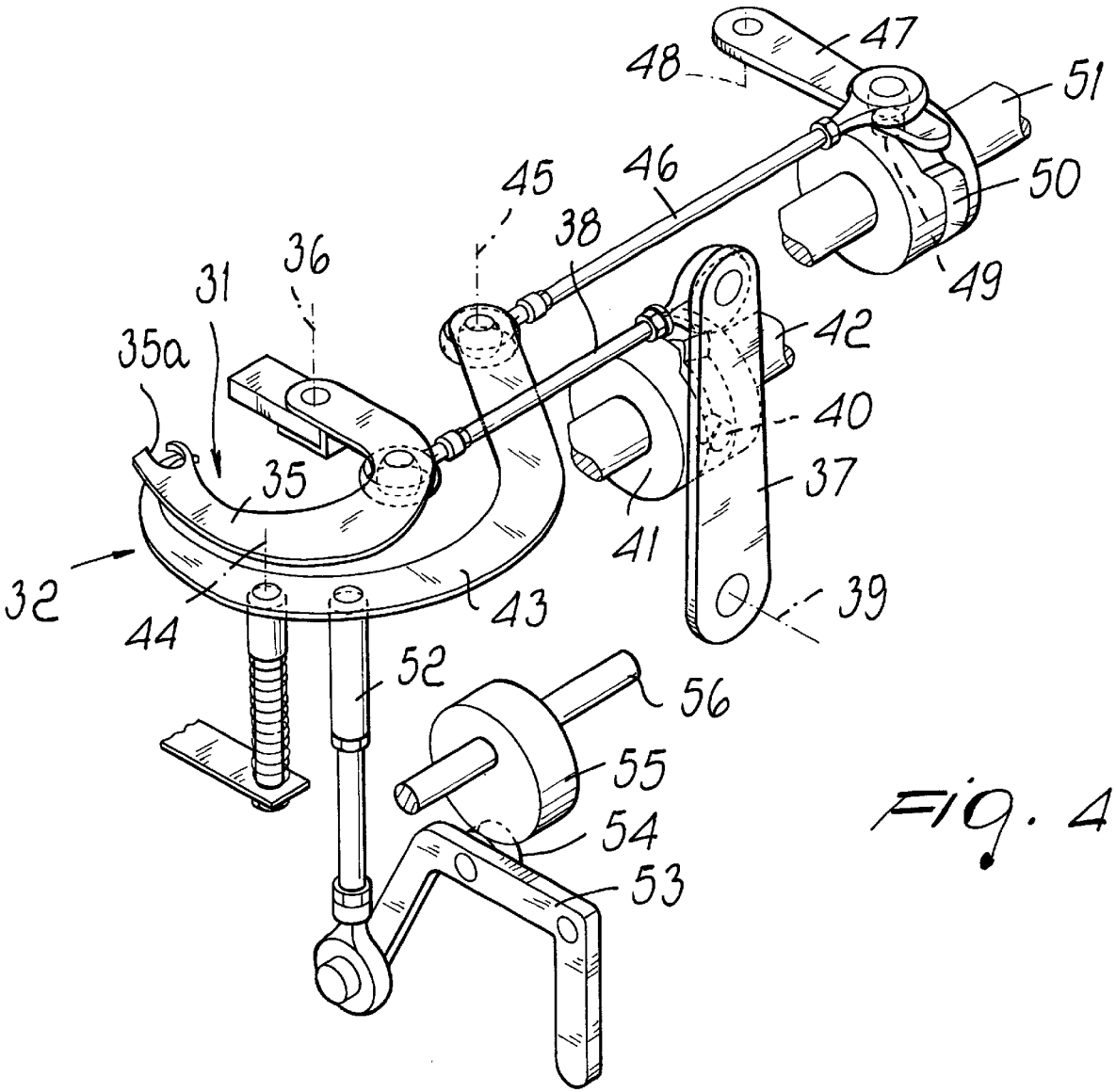
FIG. 4 is a schematic perspective view of the fork element and of the separator element with the corresponding actuation means.

With reference to the above cited figures, the machine according to the invention, shown only partially for the sake of simplicity, comprises in a per se known manner a needle 1 that has, proximate to its tip, an eye 2 open at the front and orientated so that its axis la is substantially perpendicular to a supporting surface 3 for the item 4 being sewn.

The needle 1 is actuatable with a reciprocating motion along its axis 1*a,* which is preferably orientated vertically, in order to pass cyclically through the supporting surface 3, which is preferably arranged horizontally and has, at the working area of the needle 1, a discontinuity in order to allow the needle 1 to pass through it.

Above the supporting surface 3 there are means 9 of a known type, illustrated only schematically for the sake of simplicity, for clamping an end of a draw 12 of thread having a preset length, to be used to form the seam. The clamping means 9 are engaged with one end of the draw 12 at the beginning of the seam, as will become apparent hereinafter.

Optionally, the support of the needle 1 can be provided, in a per se known manner, with an eye closing point, not shown for the sake of simplicity, which automatically closes the eye 2 of the needle 1 when the needle 1 is extracted upward from the item 4.

Below the supporting surface 3 there is a thread take-up wheel, generally designated by the reference numeral 5, which is arranged on a plane that is substantially parallel to the axis 1*a* of the needle 1 and is orientated so that its axis 5*a* is substantially perpendicular to the axis 1*a* of the needle 1.

The wheel 5 is composed of a fixed part 6 and a rotatable part 7, which can be rotationally actuated about the axis 5*a* with respect to the fixed part 6. The fixed part 6 of the wheel 5 has a circular contour around the axis 5*a,* with a discontinuity along its contour. Said discontinuity is located proximate to the working area of the needle 1.

Proximate to the peripheral region of the fixed part 6 of the wheel 5 there is a magazine 8 for the taken-up thread, with an inlet 8*a* located at one of the ends of the fixed part 6 that are formed by said discontinuity.

The rotatable part 7 of the wheel 5 is mounted coaxially on an actuation shaft 10, which can be rotationally actuated about its own axis, which coincides with the axis 5*a,* synchronously with the movement of the needle 1. The rotatable part 7 is peripherally provided with a lower looper 11, which can engage the loop of thread 12 that is cyclically carried below the supporting surface 3 by the needle 1 in order to take up, below the supporting surface 3, the portion of the draw of thread that lies between the needle 1 and the free end of the draw and load it in the magazine 8 formed in the fixed part 6 of the wheel 5.

Conveniently, the machine comprises tensioning pneumatic means for tensioning the portion of thread 12 that lies below the supporting surface 3 between the item 4 being sewn and the magazine 8 for the taken-up thread.

More particularly, the magazine 8 comprises a channel 13, which has a circular shape around the axis 5*a* and is formed proximate to the perimeter of the fixed part 6 of the wheel 5. Said channel 13 is open at the discontinuity of the fixed part 6 of the wheel 5 and on the lateral surface of said fixed part 6.

The pneumatic tensioning means comprise means for injecting a stream of pressurized air into the channel 13 in a direction that corresponds to the direction in which the thread 12 is loaded into the channel 13 by the lower looper 11.

Preferably, the air injection means comprise an air supply duct 14, which is formed in the fixed part 6 of the wheel 5. Said duct 14, which runs preferably along an arc that is centered on the axis 5*a* and has a smaller radius than the channel 13, can be connected by means of a connector 15, connected to the fixed part 6, to means for supplying pressurized air, such as for example a pressurized air distribution line or a compressor.

The duct 14 is connected to the channel 13 through at least one delivery duct 16. The outlet of the delivery duct 16 into the channel 13 is orientated in a delivery direction that corresponds to the direction in which the thread 12 is inserted in the channel 13 by the lower looper 11.

Preferably, multiple delivery ducts 16 are provided which start from the duct 14 and lead into the channel 13, with delivery directions that correspond to the direction in which the thread 12 is inserted in the channel 13 by the lower looper 11.

The channel 13 has, on its side directed toward the axis 5*a,* a raised portion 17 that partially divides the channel 13 into two contiguous portions: a first portion 13*a,* which is closer to the rotatable part 7 and is contiguous to the lateral opening 20 of the channel 13, and a second portion 13*b,* which is located further away from the rotatable part 7. These two portions 13*a* and 13*b* are in any case connected one another so as to allow the thread 12, inserted in the channel 13 through the lateral opening 20 following the rotation of the looper 11, to pass from the portion 13*a* to the portion 13*b*. The delivery ducts 16 lead into the second part 13*b* of the channel 13.

The machine has, below the supporting surface 3, thread handling means which comprise: first means 30 for moving the portion of thread 12 that lies between the item 4 being sewn to the thread magazine 8 away from the path of the needle 1, second means 31 for moving said portion of thread 12 toward the path of the needle 1, and separating means 32 for separating the two parts of the loop of thread 12 engaged by the lower looper 11.

The means 30 comprise, in a per se known manner, a hook 33 that can engage the thread 12 below the supporting surface 3 and can move, synchronously with the movement of the needle 1, so as to move the thread 12 away from the path traced by the needle 1.

The means 32 comprise a fork element 35, which has, at one of its ends, a fork 35*a* that can engage the thread 12. The fork element 35 is preferably arranged on a plane that is substantially parallel to the supporting surface 3 and is pivoted to a part of the supporting structure of the machine about an axis 36 that is substantially parallel to the axis 1*a* of the needle 1 at its end that lies opposite the fork-like end 35*a*. The fork element 35 can rotate, on its plane of arrangement, about the axis 36 synchronously with the movement of the needle 1, in order to push the thread 12, engaged with the fork 35*a*, against the shank portion of the needle 1, above the eye 2, when it is carried below the supporting surface 3. The rotary motion of the fork element 35 about the axis 36 can be achieved, as shown in particular in FIG. 14, by connecting an intermediate region of said fork element 35 to a lever 37 through a linkage 38. The lever 37 is pivoted, proximate to one of its ends, to the supporting structure of the machine about an axis 39 that is preferably arranged horizontally. A portion of the lever 37 is provided with a cam follower 40, which engages a bilateral cam 41 supported by a shaft 42 that is kinematically connected to the means for actuating the needle 1.

The other end of the lever 37 is pivoted to one end of the linkage 38, which is in turn pivoted to the intermediate portion of the fork element 35.

The separator means 32 comprise a separator element 43, which is arranged proximate to the fork element 35 and can move to open the fork 35*a* so as to allow the entry in the fork 35*a* of a segment, arranged below the supporting surface 3, of the part of the loop of thread 12 that lies, in each instance, between the lower looper 11 and the end of the draw of thread 12 clamped at the beginning of the seam and to close the fork 35*a* of the fork element 35 so as to retain within said fork 35*a* said segment of the part of the loop of thread 12.

The separator element 43 is preferably sickle-shaped and is arranged on a plane that is substantially parallel to the supporting surface 3, below the fork element 35. The separator element 43 can move, synchronously with the movement of the needle 1, toward and away from the fork element 35, and can rotate about an axis 44 that is substantially parallel to the axis 1*a* of the needle 1 in order to open and close, in each instance, the fork 35*a* of the fork element 35.

More particularly, the separator element 43 has an end that corresponds to the tip of the sickle, is arranged at the fork 35*a* of the fork element 35 and is pivoted, at its opposite end, to a linkage 46 about an axis 45 that is substantially parallel to the axis 1*a* of the needle 1. Said linkage 46 is pivoted to the separator element 43 with one of its ends, and to a lever 47 with its opposite end.

The lever 47, in turn, is pivoted at one of its ends to a portion of the supporting structure of the machine, about an axis 48 that is parallel to the axis 1*a* of the needle 1, and has, along its extension, a cam follower 49, which engages a bilateral cam 50 supported by a shaft 51 that is kinematically connected to the means for actuating the needle 1.

The separator element 43 is further movable in a direction that is substantially parallel to the axis 1*a* of the needle, preferably in a vertical direction, so as to move toward or away from the fork element 35. For this reason, the separator element 43 is connected, by means of an intermediate portion, to a rod 52 that is arranged substantially parallel to the axis 1*a* of the needle 1 and is pivoted to a lever 53, which is in turn pivoted to a portion of the supporting structure of the machine. The lever 53 is provided with a cam follower 54, which engages the profile of a cam 55 supported by a shaft 56. The shaft 56 is also kinematically connection to the actuation means of the needle 1 so that the movement of the separator element 43, both in rotation about the axis 44 and in movement toward or away from the fork element 35, is synchronized with the movement of the needle 1*a*.

In order to allow the separator element 43 to move toward and away from the fork element 35, the linkage 46 is pivoted to the separator element 43 and to the lever 47 by virtue of ball joints.

The machine according to the invention is completed, in a per se known manner, by an upper looper 60 arranged above the supporting surface 3.

The operation of the machine according to the invention is as follows.

The draw of thread 12, to be used to form the stitched seam, is cut beforehand to a preset length and clamped at one of its ends by way of the clamping means 9. The draw 12 is then engaged with the eye 2 of the needle 1 when said needle is arranged above the supporting surface 3 and the item 4 being sewn, which is deposited on the supporting surface 3.

Figure 5:
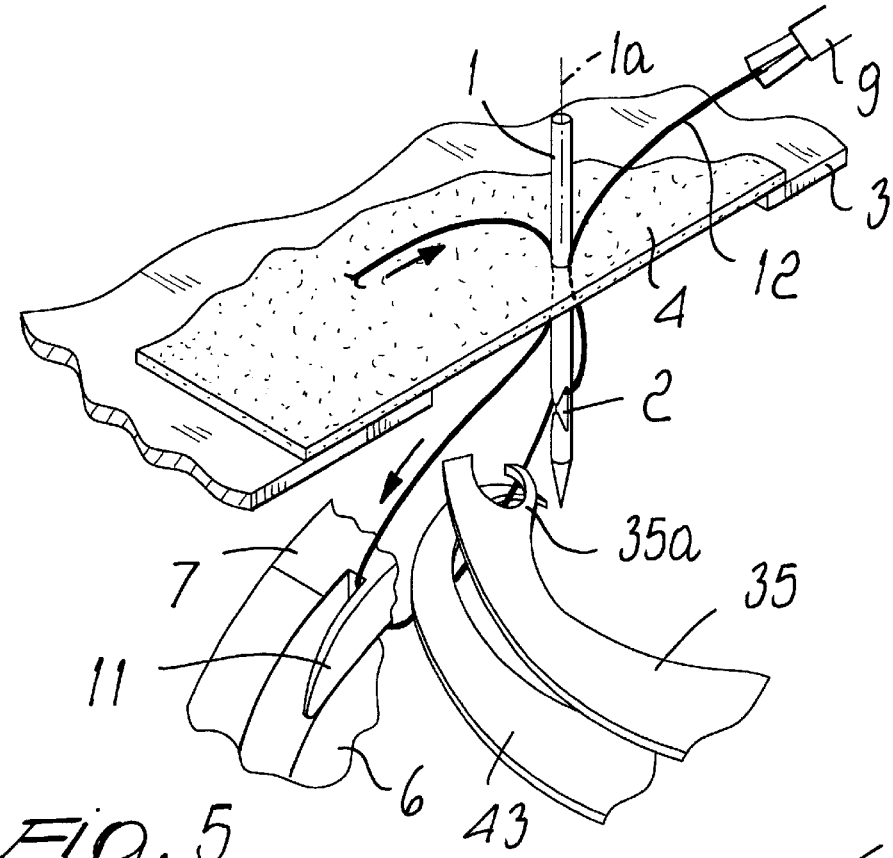
FIGS. 5 to 15 are schematic perspective views showing the execution of a running-stitch seam with the machine according to the invention.
Figure 6:
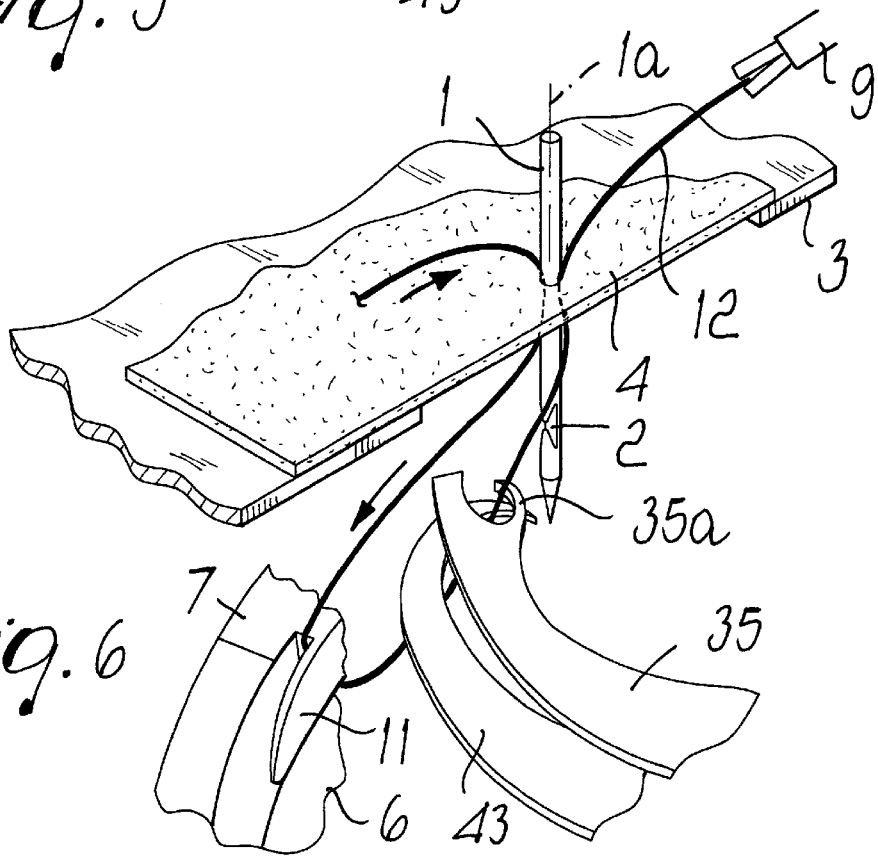

The actuation of the needle 1 then makes it pass through the item 4 and makes its eye 2 pass below the supporting surface 3. In this manner, a loop of thread 12 is moved below the supporting surface 3. Said loop of thread 12, as shown in FIG. 5, is engaged by the lower looper 11 as a consequence of the rotation of the rotatable part 7 of the wheel 5, synchronized with the movement of the needle 1. During the engagement of the thread 12 on the part of the lower looper 11, the fork element 35 and the separator element 43 are between the needle 1 and the wheel 5, with the separator element 43 spaced below the fork element 35. For this reason, the thread 12, moved by the looper 11, by passing between the separator element 43 and the fork element 35, enters the fork 35*a*, as shown in FIG. 6.

Then the separator element 43 rises toward the fork element 35, closing the fork 35*a*. In this manner, the thread 12, engaged by the fork element 35, can no longer exit from the fork 35*a*.

Figure 7:
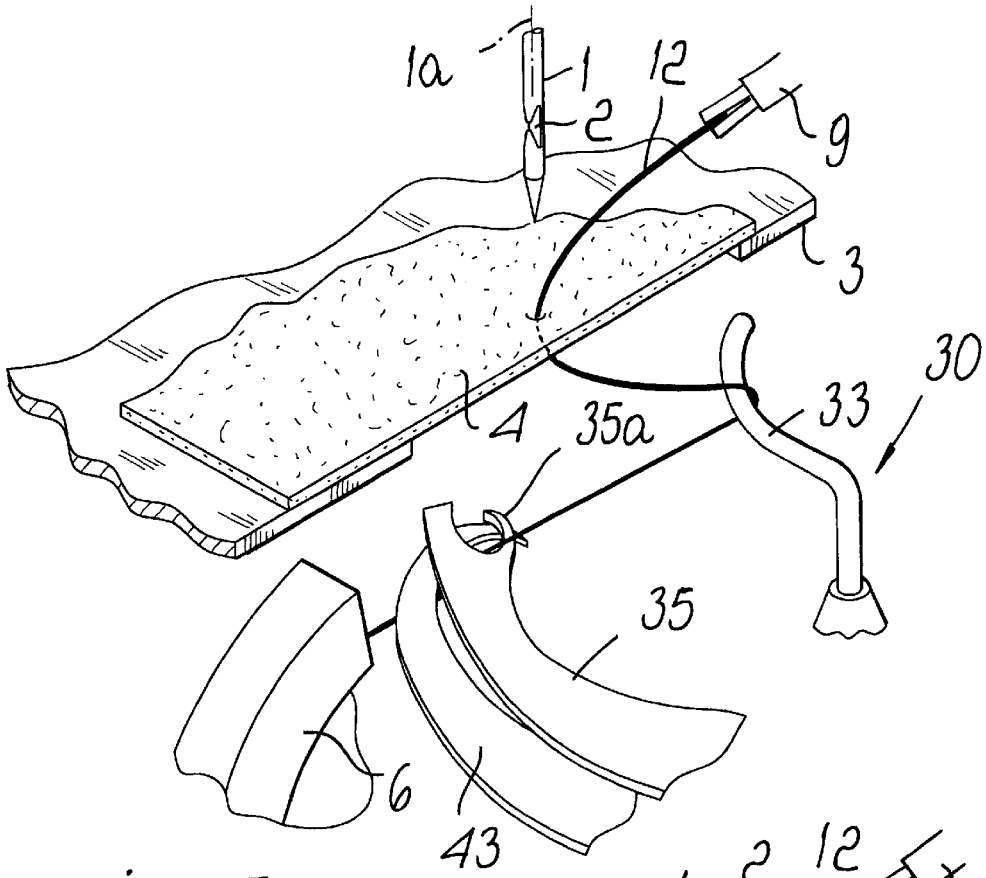

Meanwhile, the needle 1 moves upward so as to pass in reverse through the supporting surface 3 and the item 4, releasing the thread 12 below the supporting surface 3. When the needle 1 reaches its upper stroke limit, the hook 33 is activated, engages the thread 12 and moves it from the path of the needle 1, as shown in FIG. 7. The thread 12, in its portion that runs from the fork element 35 and from the separator element 43 to the free end of the draw, as a consequence of the rotation of the lower looper 11, has been taken up fully inside the magazine 8 of the wheel 5 and tensioned pneumatically by feeding pressurized air into the duct 14.

Figure 8:
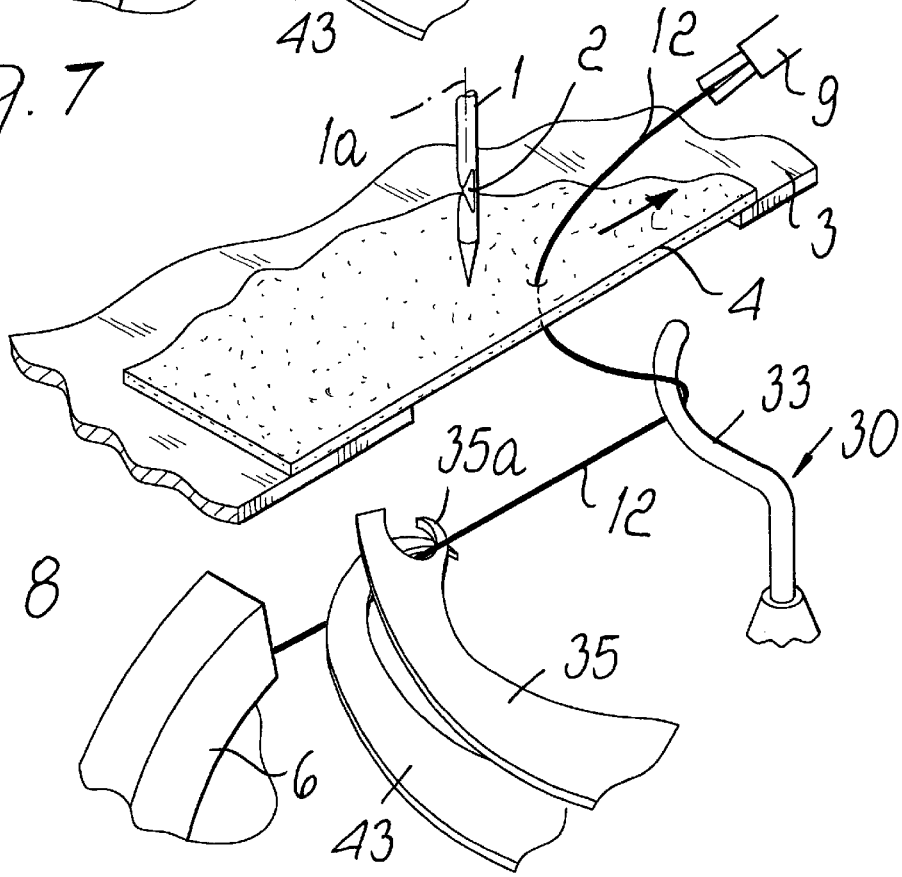

Then a new descent of the needle 1 begins, and the needle passes again through the item 4, which in the meantime has been moved, in a per se known manner, by an extent equal to the length of the stitch, arranging itself so that its eye 2 lies below the supporting surface 3, as shown in FIG. 8. It should be noted that during the descent the needle 1 does not interfere with the thread 12 arranged below the supporting surface 3, since said thread is moved away from the path of the needle 1 as a consequence of the action performed by the hook 33 and by the arrangement of the fork element 35 with the corresponding separator element 43.

The lower looper 11 passes near the needle 1 without engaging the thread, since the needle 1 is carrying no thread.

Figure 9:
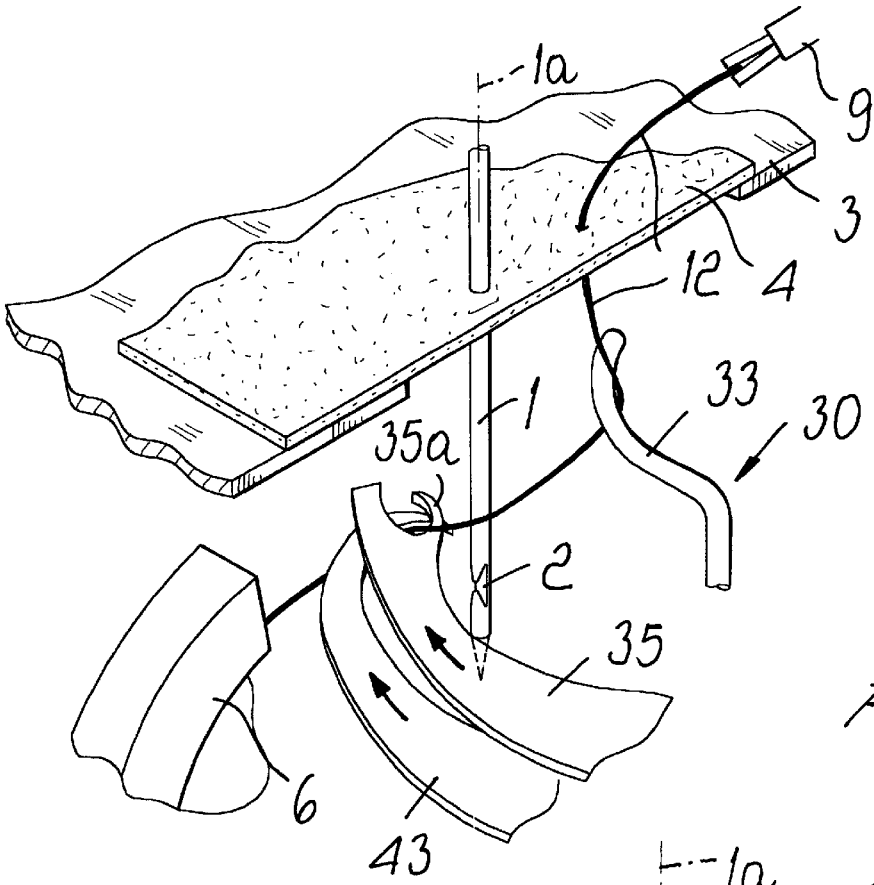

The separator element 43 and the fork element 35 then rotate about their corresponding axes 36 and 44, so as to move the thread 12 against the shank of the needle 1 above the eye 2, as shown in FIG. 9.

Figure 10:
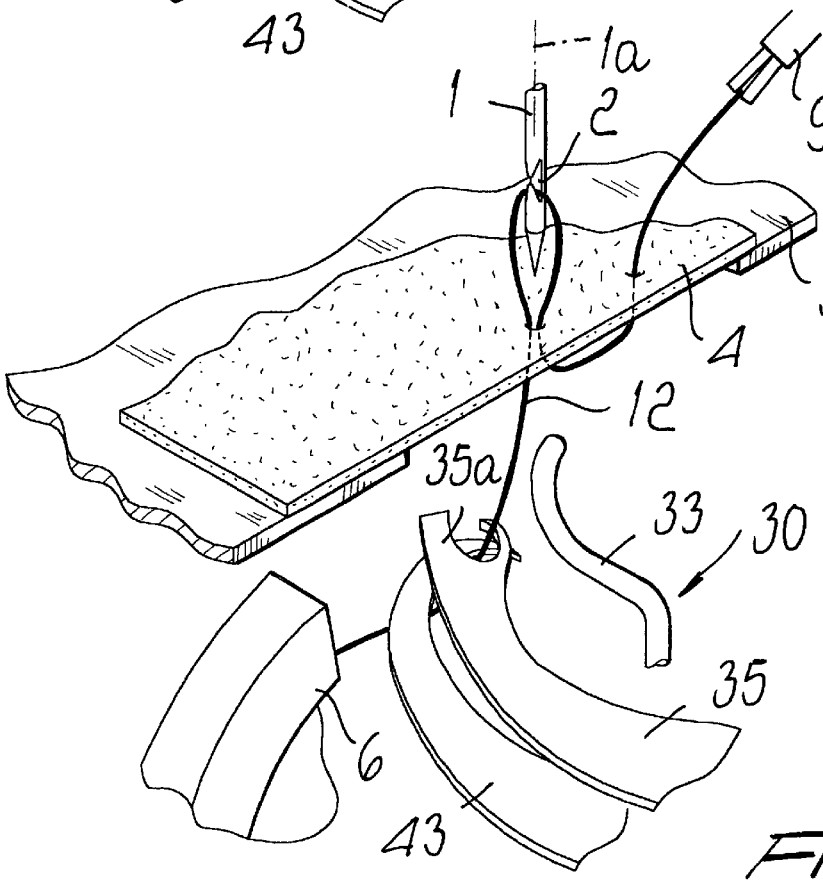

The subsequent upward movement of the needle 1, shown in FIG. 10, achieves the engagement of a loop of the thread 12 by the eye 2 of the needle 1, and said loop of thread is carried above the supporting surface 3 and the item 4 by the needle 1, while the hook 33 abandons the thread, which is tensioned pneumatically with a further injection of compressed air in the magazine 8.

Figure 11:
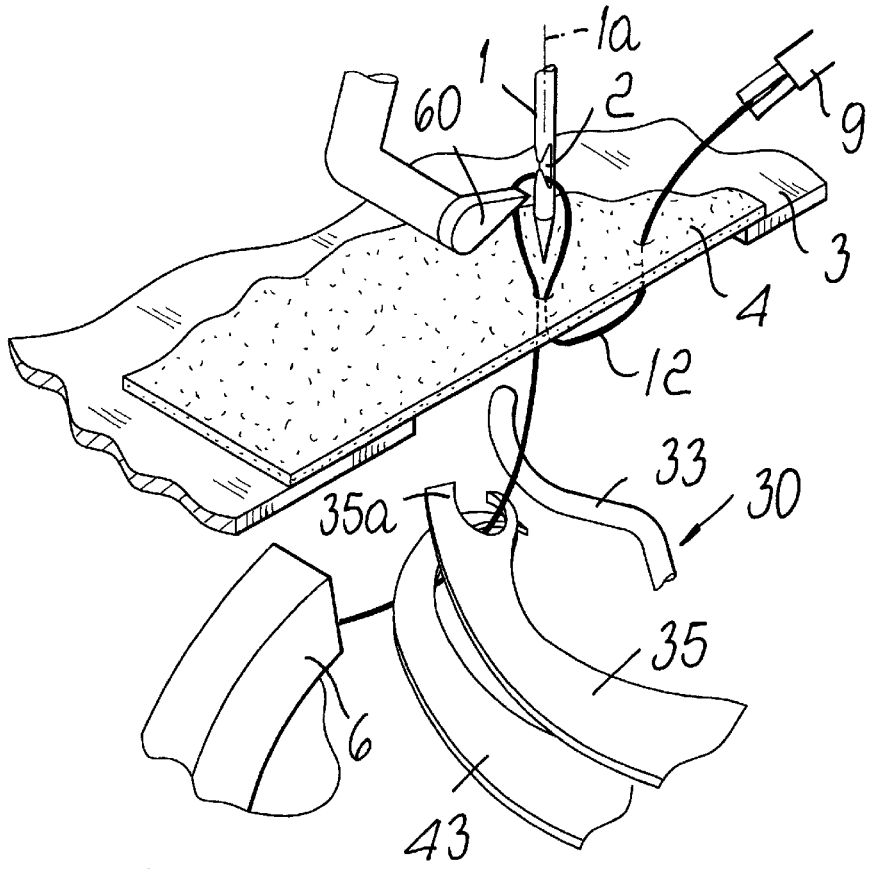

Once the loop of thread 12 has been carried above the item 4 being sewn, said loop is engaged by the upper looper 60, as shown in FIG. 11.

Figure 12:
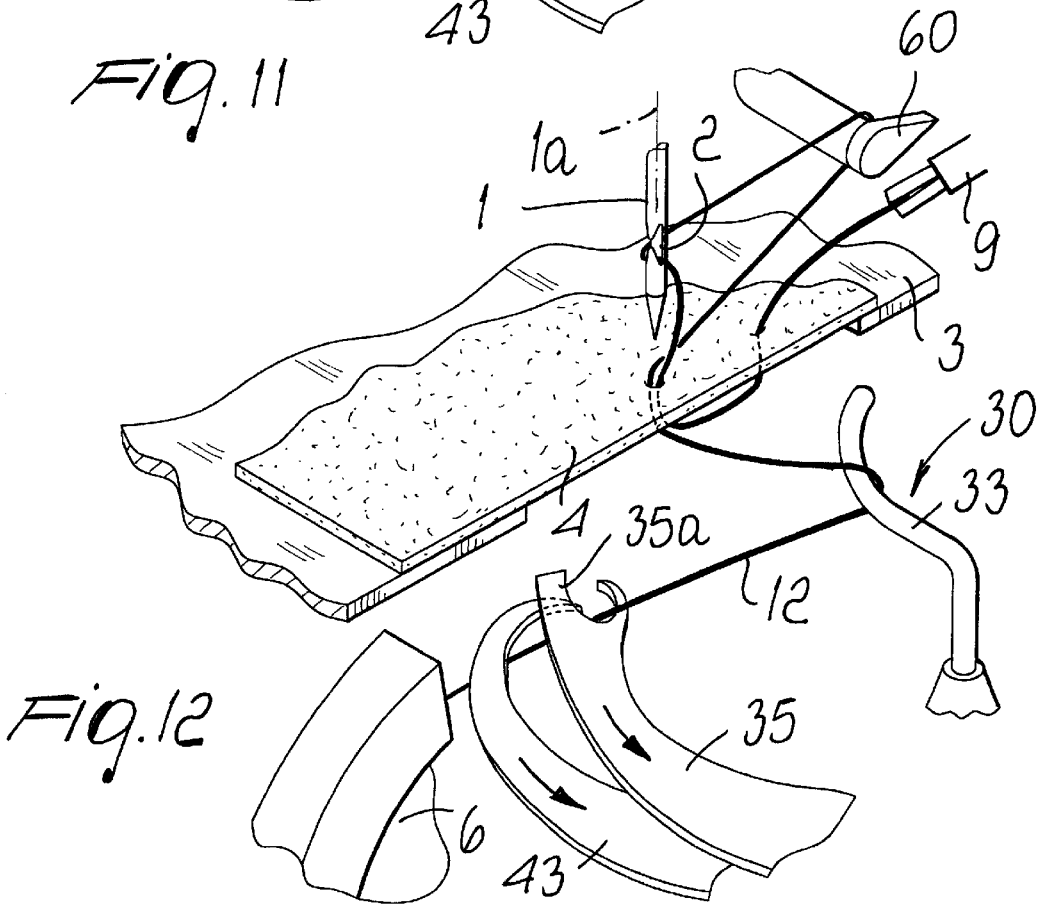

The upper looper 60 then retains and tensions the loop of thread laterally to the needle 1, while the hook 33 again moves the portion of the thread 12 that lies below the supporting surface 3 away from the path of the needle 1, as shown in FIG. 12. In this step, the fork element 35 and the separator element 43 move in the opposite direction to what has been described with reference to FIG. 9, and the separator element 43 moves downward, opening the fork 35*a* to preset itself for the subsequent step.

Figure 13:
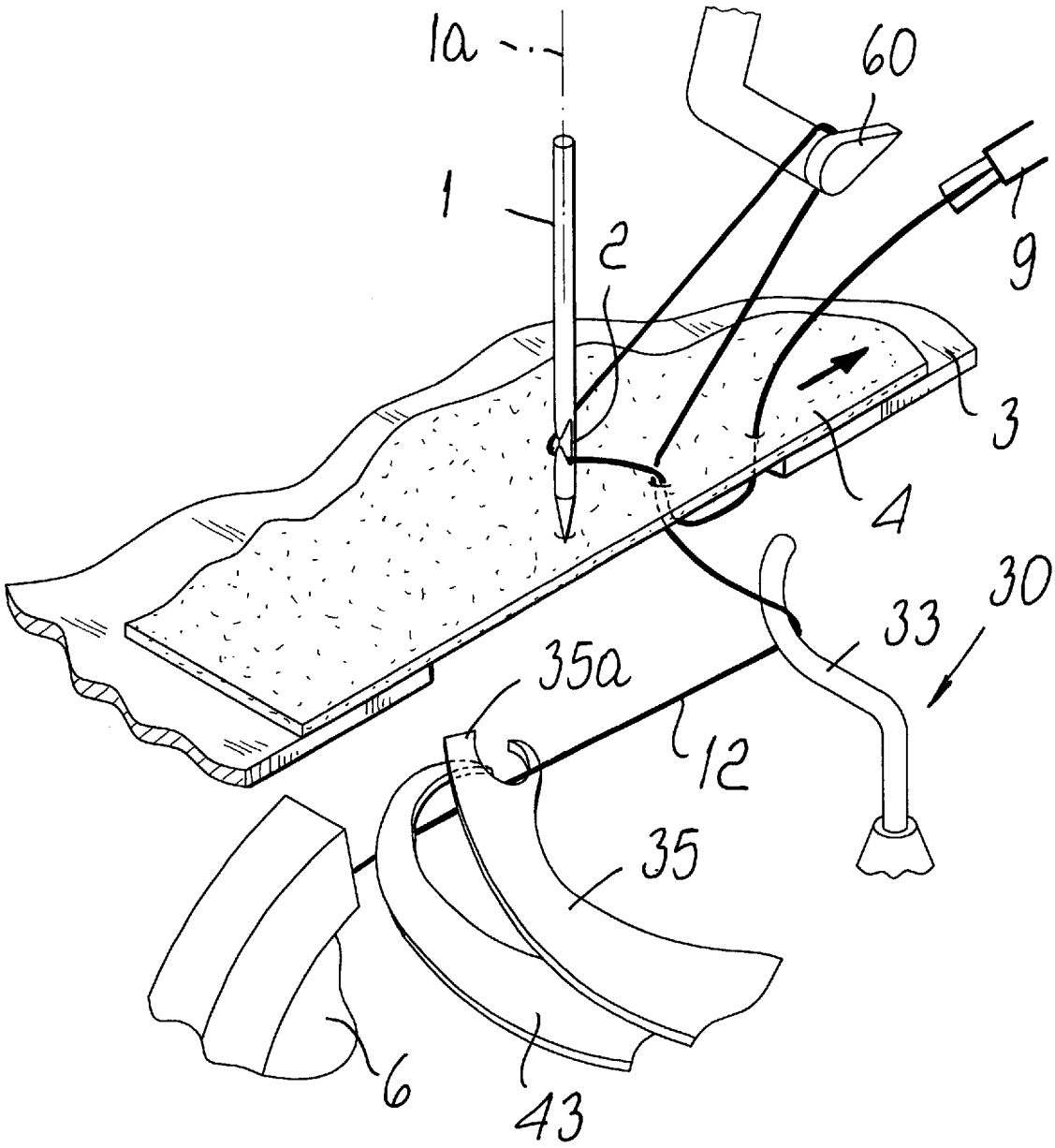

Then the needle 1, after the item 4 has been moved again by an extent equal to the length of the stitch, passes again through the item 4 and the supporting surface 4, carrying the loop of thread engaged with the eye 2 below the item 4 and the supporting surface 3, as shown in FIG. 13.

Figure 14:
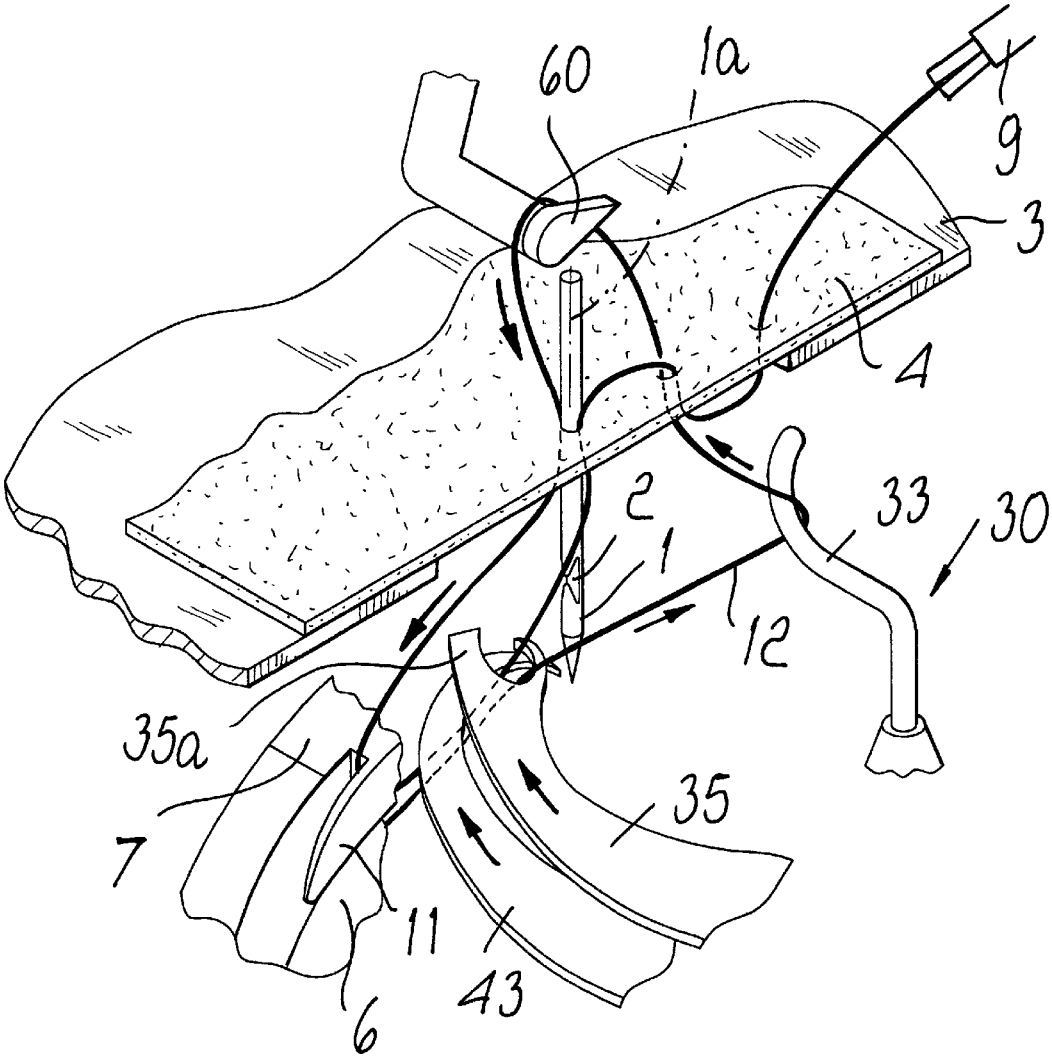
Figure 15:
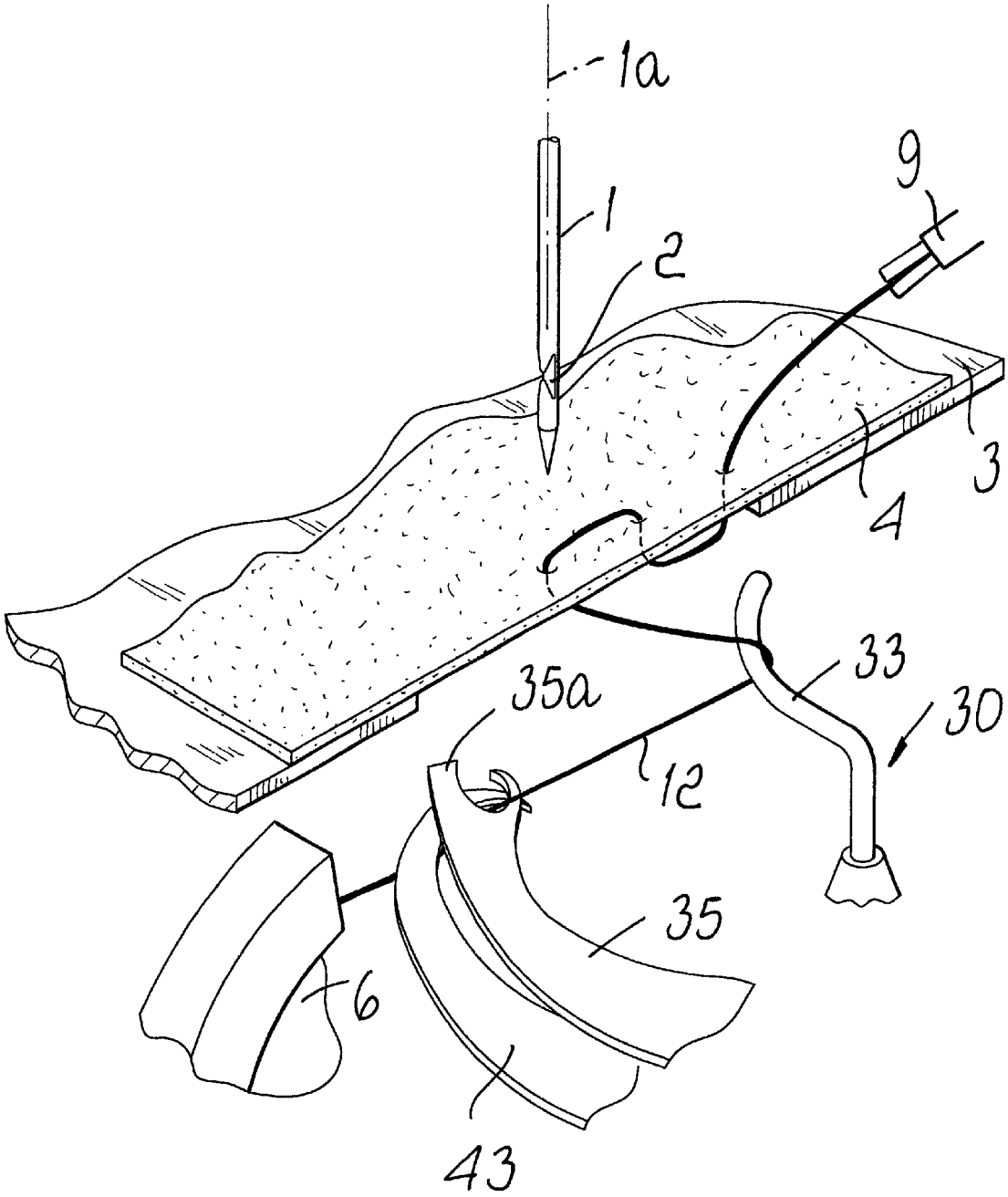

In this operating condition, as shown in FIG. 14, the separator element 43 is spaced downward with respect to the fork element 35 so that the loop of thread, carried below the supporting surface 3 and engaged by the lower looper 11, engages its part inside the fork 35*a* of the fork element 35. The rotation of the lower looper 11 causes the extraction of the thread 12 previously stored in the magazine 8 and again its loading into said magazine 8, where the thread 12 is tensioned pneumatically by means of a new injection of pressurized air. In this manner, the thread 12, except for its amount used in forming the stitches that have already been produced, is arranged entirely below the supporting surface 3. In the meantime, the separator element 43 is moved so as to close the fork 35*a* of the fork element 35, as shown in FIG. 15.

At this point, the operation of the machine continues as already described.

After forming a certain number of stitches, the end of the draw 12 can be disengaged from the clamping means in order to avoid hindering the continuation of the sewing operation.

In practice it has been found that the sewing machine according to the invention fully achieves the intended aim and objects, since it is capable of correctly forming the running-stitch seam without performing any clamping of the portion of thread that in each instance lies below the surface that supports the item being sewn. Thus thread wear is avoided and a highly uniform and precise stitched seam is obtained.

The sewing machine thus conceived is susceptible of numerous modifications and variations, all of which are within the scope of the appended claims; all the details may further be replaced with other technically equivalent elements.

In practice, the materials used, as well as the dimensions, may be any according to requirements and to the state of the art.

What is claimed is:

1. A sewing machine for forming running-stitch seams with a thread on an item supported on a supporting surface of the machine, comprising: a needle which has a tip and an open eye proximate thereto, said needle being orientated with a longitudinal axis thereof substantially perpendicular to the supporting surface and being actuatable with a reciprocating motion along said needle axis to pass cyclically along a path through the item and said supporting surface, carrying in each instance below and above said supporting surface a loop of thread of a thread draw; clamping means, for clamping one end of the thread draw, arranged above said supporting surface, with said one end being clamped at a beginning of a seam by said clamping means, while a further end of the thread draw is left free; a thread take-up wheel provided below said supporting surface, arranged on a plane that is substantially parallel to the needle axis, and having a wheel axis orientated substantially perpendicular to the needle axis, said wheel being composed of a fixed part, including a magazine for taken-up thread, and of a rotatable part, which is rotationally actuatable about the wheel axis; an actuation shaft, that is rotationally actuatable about a shaft axis, synchronously with the movement of said needle, said rotatable part of the wheel being mounted coaxially on said actuation shaft; a lower looper supported on said actuation shaft to engage the loop of thread carried below said supporting surface by said needle to take up, below said supporting surface, a portion of thread draw that lies between said needle and the free end of the thread draw and load said draw portion into said magazine formed in the fixed part of the thread take-up wheel; handling means for handling thread being provided below said supporting surface; first moving means for moving a portion of thread that lies between said item and said thread magazine away from the path of the needle; second moving means for moving said portion of thread between the item and the magazine toward the path of the needle; and separating means for separating two parts of the loop of thread engaged by said lower looper, wherein said second moving means for moving the thread toward the path of the needle comprises a fork element, said separator means comprises a separator element that is arranged proximate to said fork element and is movable so as to open the fork of said fork element in order to allow entry in the fork of a segment, located below said supporting surface, of a part of the loop of thread that lies, in each instance, between said lower looper and said end of the thread draw clamped at the beginning of the seam and close the fork of said fork element to retain inside the fork said segment of the part of the loop of thread.

2. The sewing machine of claim 1, further comprising tensioning means for tensioning the portion of thread that lies below the supporting surface, between the item being sewn and the magazine for the taken-up thread.

3. The sewing machine of claim 2, wherein said tensioning means are of a pneumatic type.

4. The sewing machine of claim 1, wherein said fixed part of the wheel has a circular contour around said shaft axis, with a discontinuity around a working area of said needle; an inlet of said taken-up thread magazine being further provided at said discontinuity, said taken-up thread magazine comprising a circular channel formed proximate to a perimeter of the fixed part of the wheel; said tensioning means comprising injecting means for injecting a stream of pressurized air into said channel in a direction that corresponds to the loading of the thread into said channel by said lower looper.

5. The sewing machine of claim 4, wherein said fork element is arranged on a plane that is substantially parallel to said supporting surface and is rotatable, synchronously with the motion of said needle, about a fork axis that is substantially parallel to the needle axis for pushing thread, engaged with said fork, against a shank portion of said needle that is carried below said supporting surface.

6. The sewing machine of claim 5, wherein said separator element is sickle-shaped and is arranged on a plane that is substantially parallel to said supporting surface below said fork element; said separator element being movable, synchronously with the movement of said needle, toward and away from said fork element and being rotatable about the fork axis that is substantially parallel to the needle axis to open and close, in each instance, said fork of the fork element.

7. The sewing machine of claim 5, further comprising an upper looper that is arranged above said supporting surface to engage, in each instance, a loop of thread engaged by said needle and carried above said supporting surface and the item being sewn.

* * * * *